United States Patent [19]

Fassauer

[11] 4,392,591

[45] Jul. 12, 1983

[54] APPARATUS FOR METERING SEMI-FLOWABLE MATERIAL

[75] Inventor: Arthur L. Fassauer, Canyon, Tex.

[73] Assignee: Geosource Inc., Houston, Tex.

[21] Appl. No.: 206,645

[22] Filed: Nov. 13, 1980

[51] Int. Cl.[3] ..... B01F 7/24

[52] U.S. Cl. ..... 222/227; 222/241; 366/296

[58] Field of Search ..... 222/227, 240, 241, 242, 222/412, 410, 411, 478; 366/295, 296, 338, 341, 339, 340

[56] References Cited

U.S. PATENT DOCUMENTS

| | | | |
|---|---|---|---|
| 2,612,298 | 9/1952 | Wearne | 222/410 |
| 3,085,756 | 4/1963 | Danforth et al. | 366/296 X |
| 3,448,968 | 6/1969 | Young | 366/338 X |
| 3,855,368 | 12/1974 | Prochazka et al. | 366/340 X |
| 3,904,335 | 9/1975 | Watkins | 222/410 X |
| 3,981,417 | 9/1976 | Fassauer | 222/227 X |
| 4,174,054 | 11/1979 | Hubbard | 222/241 |

FOREIGN PATENT DOCUMENTS

| | | |
|---|---|---|
| 446990 | 5/1936 | United Kingdom . |
| 713181 | 8/1954 | United Kingdom . |
| 844788 | 8/1960 | United Kingdom . |
| 931117 | 7/1963 | United Kingdom . |

*Primary Examiner*—Stanley H. Tollberg
*Attorney, Agent, or Firm*—Arnold, White & Durkee

[57] ABSTRACT

A multistage volumetric feeder has a storage hopper for storing a mass of semi-flowable material, such as strand fiberglass, asbestos, or titanium dioxide. The material is bottom unloaded and passed through several stages of pressure reduction, aeration, and conditioning to loosen the material and place it in a state of substantially constant density. The conditioned material is further prevented from bridging and compacting as it is volumetrically delivered to a metering stage through a segregation stage. Because the semi-flowable material is placed in an uncompacted state of substantially constant density, the feeder is capable of delivering a precise mass of material over a wide range of flow rates.

60 Claims, 13 Drawing Figures

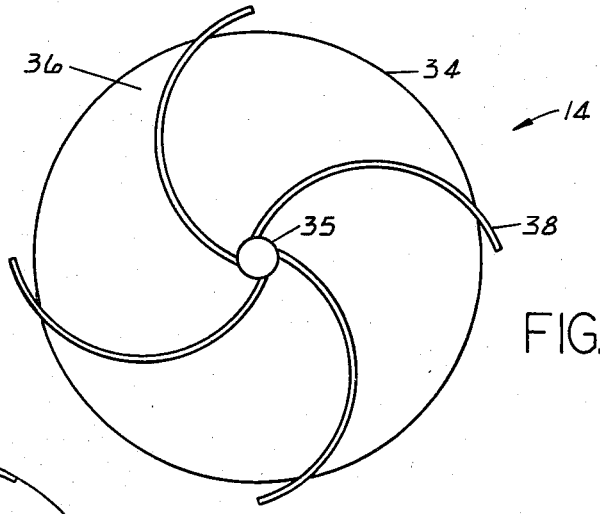
FIG. 2A
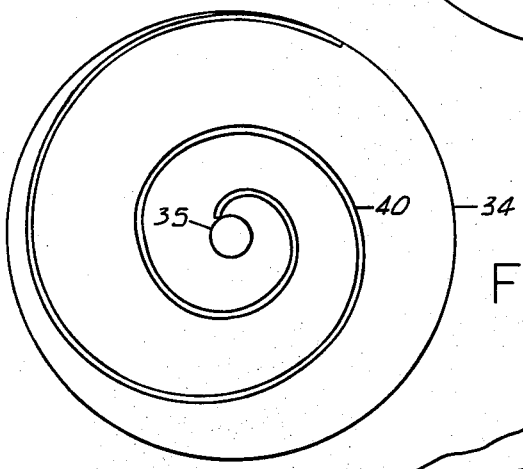
FIG. 2B
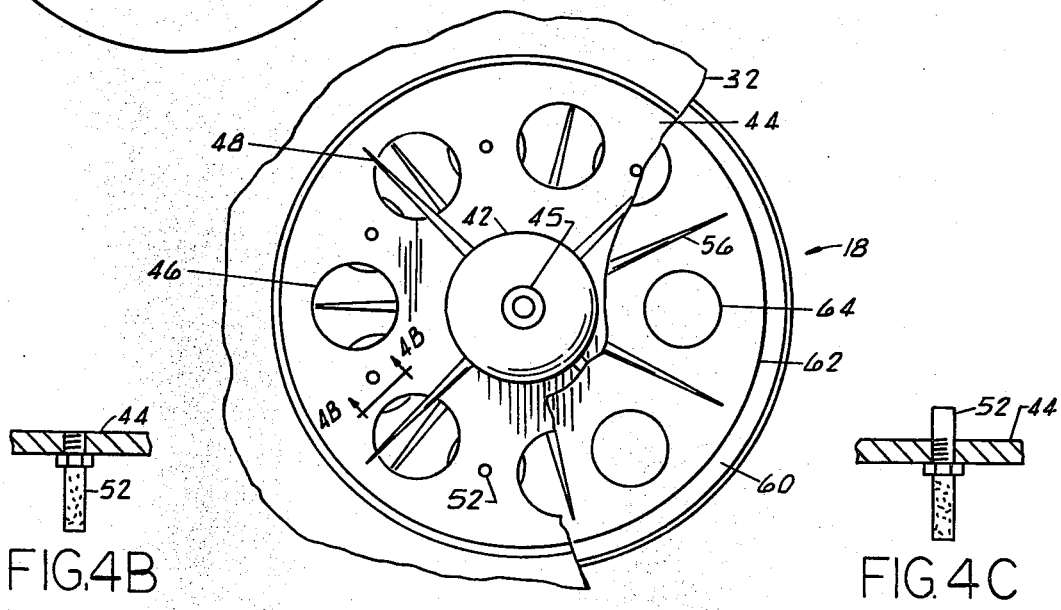
FIG. 4B
FIG. 4A
FIG. 4C

APPARATUS FOR METERING SEMI-FLOWABLE MATERIAL

BACKGROUND OF THE INVENTION

1. Field of the Invention

This invention relates generally to material metering and, more particularly, to apparatus and method for conditioning semi-flowable material into an uncompacted state prior to volumetric metering to achieve a high degree of accuracy over a wide range of flow rates.

2. Description of the Prior Art

Fibrous material, such as strand fiberglass and asbestos, and certain powdery material, such as titanium dioxide, have a natural tendency to pack and bridge, thereby forming a substantially solid mass. Such material, hereinafter referred to as semi-flowable material, has always been difficult to handle in continuous and batch processes, due to the flow characteristics of such material. Semi-flowable material has a natural tendency to bridge at the hopper throat of typical prior art single stage feeding devices, resulting in inaccurate and inconstant flow rates. Illustrative of these prior art volumetric and weigh-type feeders are devices sold under the trademarks K-Tron ®, Vibrascrew ®, and Acrison ®.

Prior art feeders have, therefore, proved unsatisfactory in metering semi-flowable material. Typically, it is necessary to resort to weighing in order to achive accurate metering of such material.

It would be advantageous to provide a metering device for accurately metering semi-flowable material. Furthermore, it would be advantageous to provide such a device which is operable over a wide range of flow rates.

SUMMARY OF THE INVENTION

By means of the present invention, there is provided an apparatus for metering semi-flowable material, such as strand fiberglass and titanium dioxide, substantially free of the disadvantages of the prior art. The metering apparatus of the present invention is a multistage feeder. The metering apparatus includes means for storing a mass of semi-flowable material, means for bottom unloading the material from the storage means, means for aerating and conditioning the semi-flowable material, means for maintaining the material in a state of substantially constant density, and means for metering the semi-flowable material with a high degree of accuracy. The metering apparatus of the present invention makes extensive use of the principle of gravity in volumetrically delivering an accurate quantity of semi-flowable material.

In one embodiment, the bottom unloading means comprises a rotational pressure plate with a plurality of curved blades molded to the upper surface of the plate for centrifugally moving the semi-flowable material outward to and over the edge of the plate. In an alternate embodiment, the curved blades extend beyond the edge of the plate to aid in aerating the semi-flowable material. In a third embodiment the rotational pressure plate is provided with a continuous spiraling blade molded to its upper surface for centrifugally moving the material outward.

The constant density means of the present invention comprises a columnar hopper for volumetrically delivering the aerated and conditioned semi-flowable material in a state of substantially constant density to the metering means. The columnar hopper includes an upper conical-shaped member, a circular plate disposed within the conical member and having a plurality of holes, and an equal number of elliptical-shaped, tubular columns extending angularly downward and inward from the horizontal plate.

One embodiment of the metering means includes a horizontal support surface having a metering edge at its perimeter. A distributing hub is rotatably mounted adjacent the upper side of the support surface and has at least one distributing blade extending horizontally outward for moving the semi-flowable material across the support surface for gravitational delivery over the metering edge. In an alternate embodiment, the metering means includes a horizontal support surface and a metering surface extending along and upwardly from the support surface to a metering edge.

The multistage metering apparatus of the present invention is capable of conditioning semi-flowable material and maintaining it in a state of substantially constant density. Furthermore, the metering apparatus provides for automatic batch or continuous process volumetric feeding of semi-flowable material at a high degree of accuracy over a wide range of flow rates.

These and other advantages and features of the present invention will hereinafter appear, and, for purposes of illustration but not of limitation, an exemplary embodiment of the present invention is shown in the appended drawing and described in the detailed description of the preferred embodiment.

BRIEF DESCRIPTION OF THE DRAWINGS

FIGS. 2A and 2B are top views of alternate embodiments of the rotational pressure plate.

FIG. 4A is a top view of the preferred embodiment of an upper aeration and conditioning stage of the present invention, partially broken away for disclosure of the relative location of a lower aeration and conditioning stage.

FIG. 4B is a side view of the preferred embodiment of a vertical probe of the present invention taken along section line 4B—4B in FIG. 4A.

FIG. 4C is a side view of an alternate embodiment of the vertical probe.

DESCRIPTION OF THE PREFERRED EMBODIMENT

Figure 1:
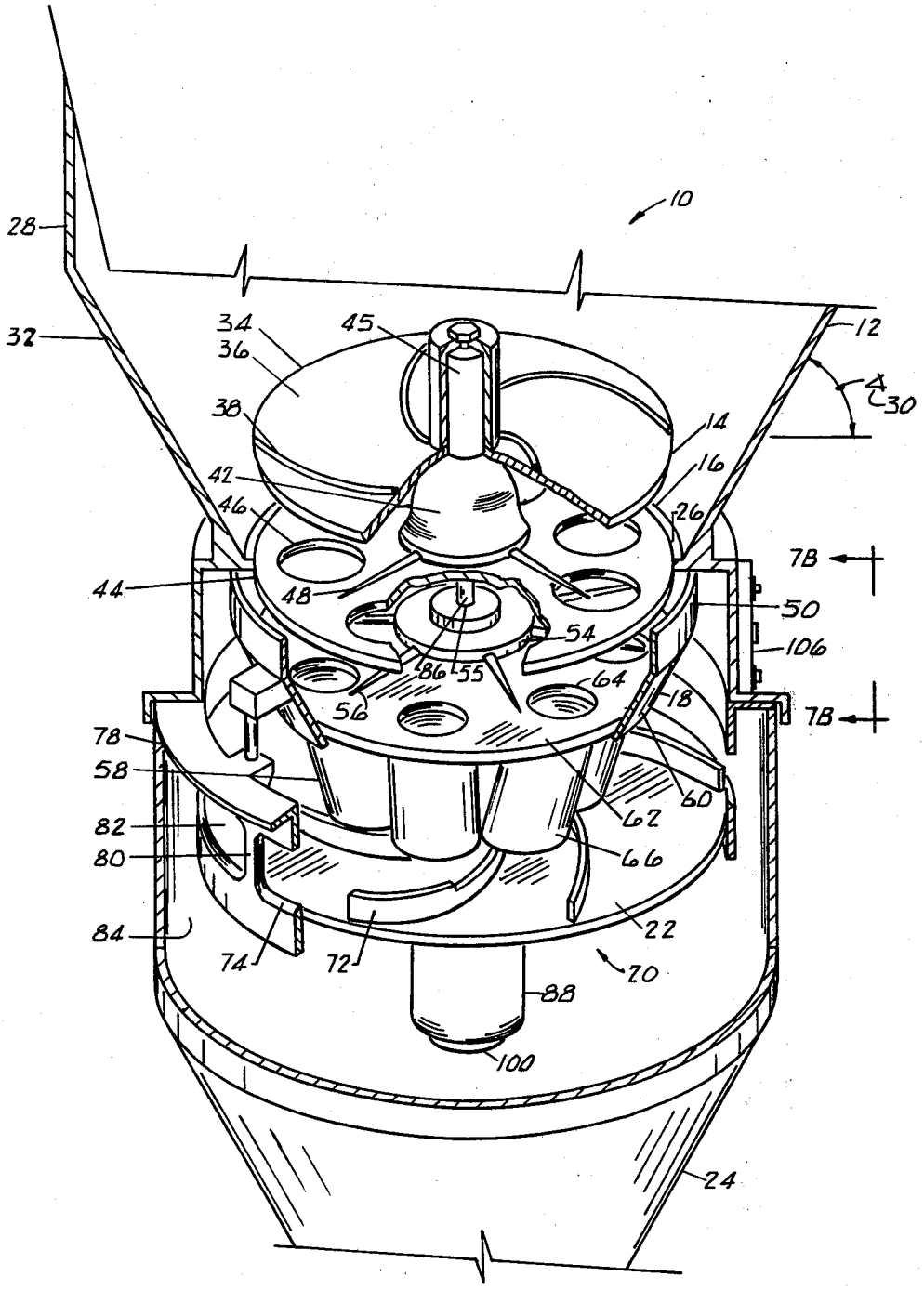
FIG. 1 is an isometric view of the preferred embodiment of a metering apparatus of the present invention, partially broken away for disclosure of detail.

Throughout the following description, similar reference numerals refer to similar elements in all figures of the drawing.

The natural tendency for fibrous material, such as strand fiberglass and asbestos, and certain powdery material, such as titanium dioxide, is to pack and bridge when manually handled or passed through prior art single stage metering devices. In contrast, most particulate material has a natural tendency to become fluidized when passed through prior art metering devices, such as those disclosed in U.S. Pat. Nos. 3,804,303 and 3,981,417 issued to Fassauer and assigned to the assignee of the present invention.

By utilizing the present invention, hereinafter described in detail, strand fiberglass and titanium dioxide can be conditioned to a semi-flowable state to provide accurate volumetric feeding of such material in an automatic continuous or batch process environment. The term "semi-flowable" is defined to describe fibrous material, such as strand fiberglass and asbestos, and certain powdery material, such as titanium dioxide, which have the natural tendency to pack and bridge when handled. All subsequent reference to the term "semi-flowable" is to be construed as including material having such inherent characteristics as strand fiberglass or titanium dioxide.

Referring to FIG. 1, shown is an apparatus 10 for metering semi-flowable material. The metering apparatus 10 comprises means 12 for storing a mass of semi-flowable material, means 14 for bottom unloading semi-flowable material from the storage means and delivering by gravitational action loosened material at a substantially reduced and controlled head pressure and density into an aeration and conditioning zone, means 16 for aerating and conditioning the loosened semi-flowable material to prevent the material from compacting and bridging and to provide material of substantially constant density, means 18 for bottom unloading the semi-flowable material out of the aeration and conditioning zone and maintaining the material in a state of substantially constant density for volumetric delivery into a distributing or metering zone, and means 20 for radially distributing the semi-flowable material outwardly across a substantially horizontal support surface 22 without inducing packing or wedging of the material for delivery by gravitational action into a collection hopper 24.

The storage means 12, such as a storage hopper, has a bottom opening 26. In the preferred embodiment, the storage hopper 12 has a cylindrical shape 28 at its upper end which extends downward at a predetermined angle 30 into a truncated conical shape 32 having the bottom opening 26 therein. In the preferred embodiment, the predetermined angle 30 has a value of substantially 65° from horizontal. The 65° slope of the lower walls 32 of the storage hopper aids in the first in-first out removal of material to effect a layering feed of semi-flowable material through the various stages of the metering apparatus. Although having the shape as previously described, it is to be understood that the storage hopper 12 may have any shape and slope, such as a completely conical shape, and still remain within the contemplation of the present invention.

In the preferred embodiment, the pressure and density reducing means 14 comprises a substantially horizontal circular member 34 having a center opening 35 (FIGS. 2A and 2B) for receiving a cylindrical extension 45 (FIG. 1) from the upper hub 42. The member 34 is rotatably mounted within the lower end 32 of the storage hopper 12. The rotational pressure plate 34 has a diameter that is less than the inside diameter of the conical-shaped end 32 of the storage hopper. The rotational pressure plate is provided with an upper surface 36 for centrifugally moving the semi-flowable material to and over the outer edge of the plate. In the preferred embodiment, the rotational circular member 34 has a plurality of curved blades 38 molded to the upper surface of the plate 34 for centrifugally moving the material outward to and over the edge of the plate. In the preferred embodiment, four blades having a width of $\frac{1}{4}''$ and a depth of $\frac{1}{4}''$ are provided on the rotational pressure plate. In one alternate embodiment shown in FIG. 2A, the curved blades 38 extend beyond the edge of the plate 34 to aid in aerating the semi-flowable material. In a second alternate embodiment, a continuous spiraling blade 40 (FIG. 2B) is molded to the upper surface of the plate 34. It is to be understood that the pressure and density reducing means 14 may have other embodiments, such as an elongated, thin rod rotatably mounted, and still remain within the contemplation of the present invention.

The aeration and conditioning means 16 comprises two stages in the preferred embodiment. The first aeration and conditioning stage includes an upper hub 42 having a centrally located bottom opening (not shown) for receiving the threaded end of a drive shaft 86. The hub 42 is rotatably mounted between the rotational circular plate 34 and a stationary pressure plate 44 having a center opening (not shown) for the drive shaft to pass through. The stationary plate 44, $\frac{1}{4}''$ thick$\times 11\frac{5}{8}''$ diameter, has a plurality of holes 46 therein and encloses the bottom opening 26 in the storage hopper 12. In the preferred embodiment, the holes 46 in the stationary pressure plate 44 number seven and are equally spaced at an equal radial distance from the center of the stationary plate. The stationary plate 44 may have any number of holes arranged in any geometric pattern and with any diameter, and still remain within the contemplation of the present invention.

The upper hub 42 has a substantially hemispherical shape and a cylindrical extension 45 (FIG. 4A), which extends through the center opening in rotational pressure plate 34. A plurality of tapered arms 48 extending substantially horizontally outward are disposed about the upper hub. In the preferred embodiment, four tapered arms, $3\frac{1}{2}''$ in length and $3/32''\times 1/16''$ tapered, are equally spaced about the hub 42.

The second aeration and conditioning stage comprises a material retaining ring 50, a plurality of vertical probes 52, and a lower hub 54 rotatably mounted. In the preferred embodiment, the vertical probes 52 (FIG. 4B) are threadably connected to the stationary pressure plate 44 and extend substantially vertically downward into the air space or void enclosed by the annular retaining ring 50, which has a $12\frac{5}{8}''$ diameter$\times 1\frac{1}{8}''$ height. The vertical probes 52 are equally spaced between adjacent holes 46 in the stationary plate 44 at the same radial distance as the holes. In the preferred embodiment, seven vertical probes having a substantially cylindrical shape and $\frac{1}{2}''$ diameter$\times 1''$ length are utilized. The vertical probes assist in keeping the previously conditioned semi-flowable material from spinning and packing and further aerate and condition the material. The probes also assist in delivering the conditioned material into the constant density maintaining zone 18. In an alternate embodiment shown in FIG. 4C, the vertical probes 52 extend above and below the plate 44. It is to be understood that the vertical probes may admit of any quantity and shape and may be affixed to the stationary plate in any manner and location and still remain within the contemplation of the present invention.

The lower hub 54 has a circular disc-like shape and a center opening 55 for the drive shaft to pass through. A plurality of tapered arms 56 extending substantially horizontally outward are equally spaced about the lower hub. In the preferred embodiment, seven tapered arms, 3¼" in length and 3="×1/16" tapered, extend outward from the hub 54. Although the arms 48 and 56 extending from the hubs 42 and 54, respectively, are tapered, substantially horizontal, and equally spaced, it is to be understood that such arms may be of any quantity, shape, and configuration, such as a single, flexible arc-shaped rod, and still remain within the contemplation of the present invention. Furthermore, the aeration and conditioning zone may have any number of stages, including a single stage, and still remain within the contemplation of the present invention.

Figure 3A:
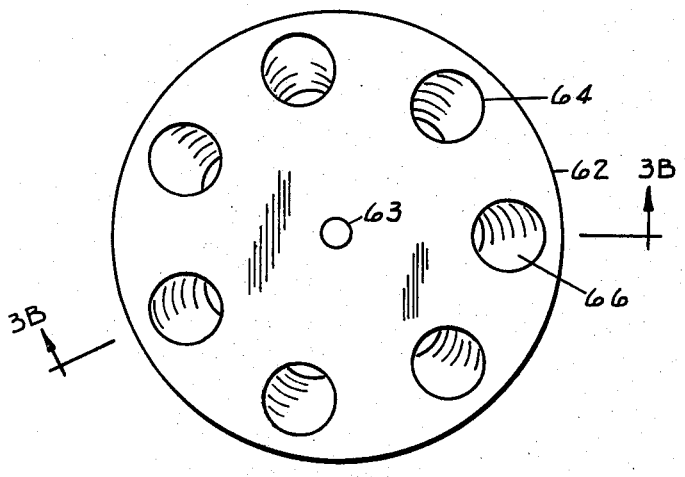
FIG. 3A is a top view of the preferred embodiment of a columnar hopper of the present invention.
Figure 3B:
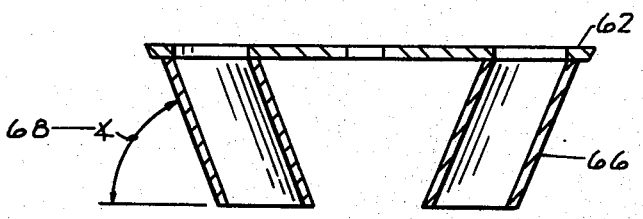
FIG. 3B is a cross-sectional view of the columnar hopper taken along section line 3B—3B in FIG. 3A.

The constant density maintaining means 18 comprises a columnar metering hopper 58 for bottom unloading the conditioned semi-flowable material out of the aeration and conditioning zone and volumetrically delivering the material into the metering zone. The columnar hopper includes an upper conical-shaped member 60 having its upper edge located adjacent to the bottom edge of the material retaining ring 50. A substantially horizontal circular plate 62 having a center opening 63 (FIG. 3A) is disposed within the conical member 60. The circular plate, ¼" thick×11⅝" diameter, has a plurality of holes 64 therein. The holes 64 preferably number seven and are equally spaced at an equal radial distance from the center of the plate, as shown in FIG. 3A. An equal number of elliptical-shaped, tubular columns 66 having top and bottom openings extend downward and inward at a predetermined angle 68 (FIG. 3B) from the holes in the circular plate 62. In the preferred embodiment, seven columns 66 having an altitude of 4" extend inward at an angle of substantially 70° from horizontal. The slope of the columns assists in preventing the semi-flowable material from packing and bridging, which allows for volumetric control of the conditioned material into the metering stage.

Referring to FIG. 4A, shown is a top view of the first aeration and conditioning stage partially cut away to disclose the relative position of the holes 64 in the plate 62 in relation to the holes 46 in the plate 44. In the preferred embodiment, the holes 46 have a 2½" diameter while the holes 64 have a 2" diameter. Although the holes 64 are shown symmetrically offset from the holes 46, it is to be understood that the holes 64 may be offset by any distance from the holes 46 and still remain within the contemplation of the present invention. Furthermore, any combination of holes having any diameter may be provided in each plate, such as six holes of varying diameter in plate 44 and five smaller holes all of the same diameter in plate 62, and still remain within the contemplation of the present invention.

Figure 5A:
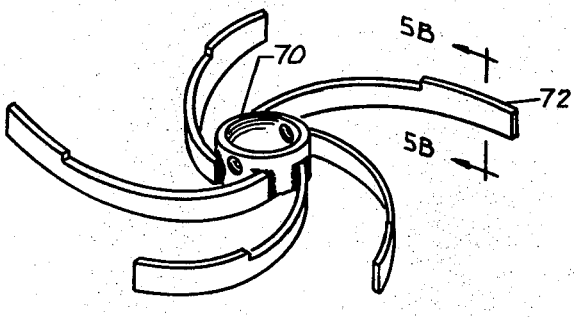
FIG. 5A is an isometric view of the preferred embodiment of a distributing hub and associated blades of the present invention.
Figure 5B:
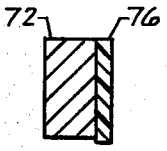
FIG. 5B is a sectional view of the preferred embodiment of a distributing blade of the present invention taken along section line 5B—5B in FIG. 5A.

The distributing means 20 comprises an annular distributing hub 70 (FIG. 5A) rotatably mounted adjacent the support surface 22 (FIG. 1). The distributing hub has at least one blade 72 extending substantially horizontally outward to a substantially continuous metering edge 74 at the outer perimeter of the support surface 22 (having a 15" diameter). As shown in FIG. 5A, the preferred embodiment of the distributing means 20 includes five blades sweeping a 7⅜" radius and having an arc shape and a flat face of ¾" height. The flat face design provides a positive delivery of the semi-flowable material out to and over the metering edge. The blades are equally spaced about the distributing hub and substantially tangentially secured thereto. As shown in FIG. 5B, the distributing blades 72 have a bearing-type facing surface 76, such as nylon, extending 1/16" below the bottom of the blades for maintaining a frictionless contact with the support surface 22 during rotation. It may be necessary to provide an upward tension on the support surface to assure a positive contact between the support surface and the distributing blades, thereby preventing wedging of the semi-flowable material.

An annular collar member 78 is disposed above the material support floor 22 which has a center opening therein (not shown). The support floor is suspended from the collar member by a plurality of rod members 80. In the preferred embodiment, four rod members are disposed at equidistant points along the perimeter of the support surface and collar member. The lower edge of the collar member and the metering edge 74 adjacent the perimeter of the material support floor 22 form a substantially continuous slot 82 therebetween, typically 1½" in height. A void 84 between the slot 82 and the interior surface of the metering apparatus 10 allows the semi-flowable material to pass over the metering edge 74 and fall by gravitational action into the collection hopper 24. In the preferred embodiment, the metering edge comprises a substantially beveled edge.

Figure 6:
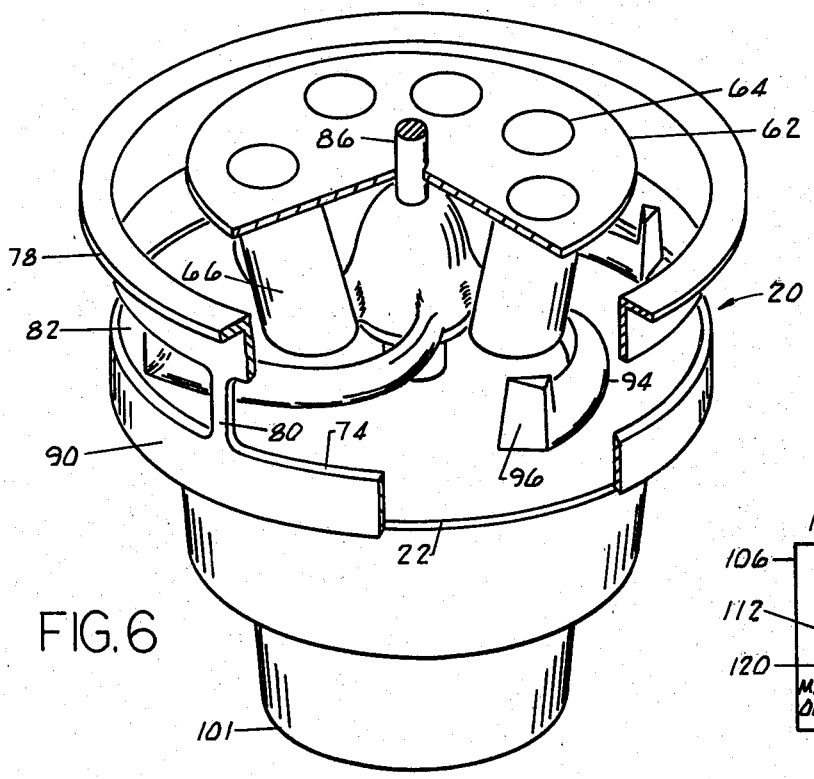
FIG. 6 is an isometric view of an alternate embodiment of the distributing hub and associated blades.

Shown in FIG. 6 is an alternate embodiment of the distribution zone 20. As shown, a vertical wall or metering surface 90 extends along and upward from the support surface to form the metering edge 74 at its upper edge. The metering surface 90 is suspended from the collar member 78 by the rod members 80. The lower edge of the collar member and metering edge 74 form the continuous slot 82 therebetween at an elevated location with respect to the support surface.

In conjunction with the elevated metering edge, an alternate embodiment of the distributing hub and associated blades is provided. As shown, a distributing hub 92 having a substantially hemispherical shape is provided with four curved outwardly extending sweeps 94. The bottom edge of the sweeps 94 is essentially level with the elevated metering edge 74 to form a layer of material between the upper surface of support floor 22 and metering edge 74. This layer or cushion of material aids in further preventing wedging of the material.

Each sweep 94 is terminated by a vertically extending riser portion 96. The aerodynamic shape of the leading surface of the sweeps enables further conditioning of the semi-flowable material, as described in detail in aforementioned U.S. Pat. Nos. 3,804,303 and 3,981,417 which are incorporated by reference. It is to be understood that the distributing blades or sweeps may admit of any quantity, shape, and configuration and still remain within the contemplation of the present invention.

Drive shaft means 86 is provided to conjointly rotate distributing hub 70, lower hub 54, upper hub 42, and rotational pressure plate 34. Means 88, such as a ¼ hp Bodine gear motor, is provided to rotate the drive shaft through a conventional gear reduction box (not shown).

Figure 7B:
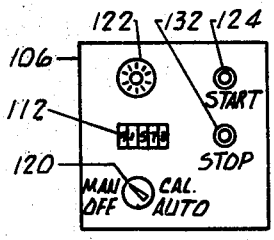
FIG. 7B is a general arrangement of a unit control panel for the metering apparatus.
Figure 7A:
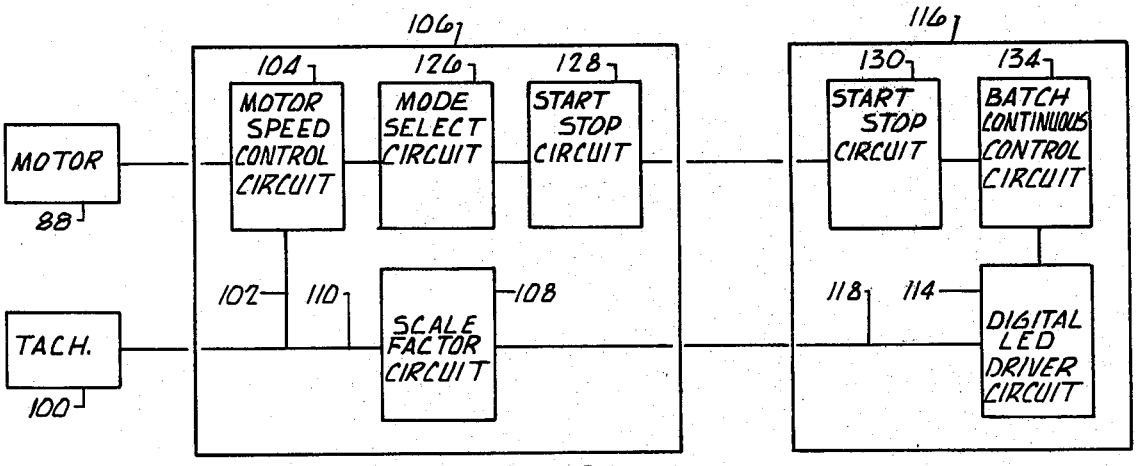
FIG. 7 is a block diagram of the digital control system of the present invention.

Referring now to FIG. 7A, shown is a block diagram of the digital control system of the present invention. A tachometer 100 (FIG. 1) is attached to the motor 88 at the end of the motor shaft opposite the gear reduction box. A protective cover 101 (FIG. 6) may be provided over the motor and tachometer. The tachometer provides a feedback signal 102 to a motor speed control circuit 104 contained within a unit control panel 106 (FIG. 7B). The tachometer also produces thirty-two pulses per revolution of the motor, which pulses drive a scale factor circuit 108 over line 110.

As the quantity of material dispensed from metering apparatus 10 is directly proportional to the number of revolutions of the blades or sweeps, the quantity of material is therefore directly proportional to the number of pulses produced by the tachometer. The following relationship may be established:

$$W=K*P$$

where

W is the weight of the material in grams, ounces, pounds, or 1/100th pound;

P is the number of pulses produced by the tachometer; and

K is the proportionality constant or scale factor for a particular type of material.

The scale factor K is a value within the range of 0.00001 and 0.99999. The appropriate scale factor is preset into a five-digit thumbwheel 112 (FIG. 7B) mounted on the unit control panel 106. The scale factor circuit 108, in conjunction with the thumbwheel 112, drives a digital LED driver circuit 114 in a remote operation programming panel 116 over line 118. The circuit 114 drives an LED display (not shown) mounted on the remote panel 116.

To calibrate the metering apparatus for a particular type of material, a mass of semi-flowable material, such as strand fiberglass, asbestos, titanium dioxide, powdered eggs, or the like, is loaded into the storage hopper 12. A four-position mode switch 120 (FIG. 7B) mounted on the unit control panel 106 and associated with a mode select circuit 126 (FIG. 7A) is set to the manual position, and the motor speed control circuit 104, through a potentiometer 122, is set to mid-range (50%). The scale factor thumbwheel 112 is set to 99999 (representing a unity scale factor). The motor is started by a start switch 124 associated with a start/stop circuit 128 (FIG. 7A), and metering apparatus 10 is operated for a period of time, such as ten minutes, until the apparatus is charged. The motor may also be started by a switch (not shown) associated with a start/stop circuit 130 in the remote panel 116.

The machine is stopped by switch 132 when charging is complete, the LED display (not shown) is then reset, and the machine is re-started for sampling. After collecting a sample of the material, the machine is stopped and the sample is weighed. The weight of the sample is divided by the value appearing on the LED display to yield the appropriate scale factor. This scale factor is then dialed into the thumbwheel 112, and the mode switch 120 is set to the automatic position. The apparatus is now ready for operation. Thereafter, each pulse of the tachometer is equivalent to one unit in grams, ounces, pounds, or 1/100th pounds, depending upon whichever unit of measurement was utilized to weigh the sample. Any reading on the LED display is equivalent to the weight of the material in the selected unit.

The machine may also be calibrated by placing the mode switch 120 in the calibrate position, in which case it is unnecessary to adjust the scale factor thumbwheel 112 to 99999, as the scale factor circuit is automatically set to a unity value. The remaining steps of the aforementioned procedure may then be followed to obtain the appropriate scale factor for a particular type of material. Once the metering apparatus is calibrated for a particular type of material, the machine will deliver a substantially constant mass of material (±1.0% accuracy) for every complete rotation of the distributing hub and blades.

A batch/continuous control circuit 134 is also provided in the remote panel 116. The circuit 134 provides the capability of batch mode or continuous mode operation of the metering apparatus.

The metering apparatus 10 operates under the principle that some volume of material is metered for each revolution of the sweep. For any single semi-flowable material, a substantially constant mass of material is delivered for every complete revolution, regardless of the speed of the motor. Similarly, equal fractional revolutions will dispense a substantially constant mass of material.

The semi-flowable material is bottom unloaded from the storage hopper 12 to provide a first in-first out delivery of material. During operation the rotational plate 34 revolves and centrifugally moves the lowermost layer of semi-flowable material stored in the hopper to the outer edge of the plate where the material is allowed to fall by gravity into the void below the rotational plate. This action serves to initially loosen the material and place it in a state of lesser density.

The conjoint rotation of the upper hub 42 and arms 48 begins to aerate and condition the loosened mass of material and further reduce the density of the material as it falls through the seven openings in the stationary pressure plate 44. The stationary plate further reduces the head pressure of the semi-flowable material as it is gravitationally delivered to the second aeration stage where the lower hub 54 and arms 56 continue to aerate and further condition the material, thereby further reducing the density of the material. The vertical probes 52 prevent the material from balling up or spinning as the material is aerated and conditioned and delivered gravitationally to the columnar hopper 58. Offsetting the holes 64 in the circular plate 62 from being directly underneath the holes 46 in the plate 44 serves to further reduce the head pressure of the material.

When the material reaches the columnar hopper, it has been conditioned to an uncompacted state of substantially constant density. The columnar hopper serves to maintain the material in an uncompacted state by segregating the material, thereby alleviating the problem of bridging and packing. The uncompacted material is volumetrically delivered through the angulated columns onto the support surface 22. The slope of the columns aids in preventing the material from bridging as it is delivered into the metering zone.

The distributing blades 72, the bearing faces of which are in contact with the support surface, shear off the material as it is volumetrically delivered through the bottom opening in the columns 66 and centrifugally move the material outward to the metering edge 74 where the material is gravitationally delivered to the collection hopper 24. The flat, bearing faces of the distributing blades enable the material to be delivered without promoting any wedging, bridging, or compacting of the conditioned material.

In the above detailed description, it can be seen how the metering apparatus of the present invention conditions the semi-flowable material to be metered by aerating and conditioning it into a uniformly uncompacted state prior to volumetric metering. Utilization of the columnar hopper of the present invention in conjunction with one or more stages of aeration and conditioning enables the metering apparatus of the present invention to volumetrically meter material with a high degree of accuracy over a wide range of flow rates. It is to be understood that any number and combination of pressure reducing stages and aeration and conditioning stages may be provided in conjunction with the columnar hopper and still remain within the contemplation of present invention.

Having described the invention in connection with certain specific embodiments, it is to be understood that the invention will admit of other embodiments. The description of the preferred embodiment is given only to facilitate understanding of the invention by those skilled in the art and should not be construed as limiting the invention itself which is defined herein by the appended claims.

What is claimed is:

1. An apparatus for metering semi-flowable material, comprising:

a hopper for receiving a mass of semi-flowable material, said hopper having a bottom opening therein;

means for bottom unloading the semi-flowable material from the hopper and delivering said material in loosened condition and at a substantially reduced and controlled head pressure and density into an aeration and conditioning zone;

means for aerating and conditioning the loosened semi-flowable material to prevent the material from compacting and bridging and to place the semi-flowable material in a state of substantially constant density, said aerating and conditioning means including a stationary pressure plate supported in the bottom opening of the hopper and having a plurality of holes therethrough, an upper hub rotatably mounted above the stationary pressure plate and having at least one arm extending outward therefrom, a lower hub rotatably mounted below the stationary pressure plate and having at least one arm extending outward therefrom, and a plurality of substantially vertical probes extending downward from the bottom surface of the stationary pressure plate;

means for bottom unloading the semi-flowable material from the aeration and conditioning means and maintaining the material in a substantially constant density state for volumetric delivery into a distributing zone; and means for distributing the semi-flowable material without inducing packing and bridging of the material for delivery by gravitational action into a collection hopper.

2. A metering apparatus according to claim 1 wherein the hopper has a cylindrical shape at its upper end and a lower end which extends downward at a predetermined angle to define a truncated conical shape having the bottom opening therein.

3. A metering apparatus according to claim 2 wherein the lower end of the hopper extends downward at an angle of substantially sixty-five degrees from horizontal.

4. A metering apparatus according to claim 1 wherein the pressure and density reducing means is a substantially horizontal circular member rotatably mounted within the lower end of the hopper.

5. A metering apparatus according to claim 4 wherein the rotatably mounted circular member has a plurality of curved blades thereon for centrifugally moving the material outward and over the edge of said circular member.

6. A metering apparatus according to claim 4 wherein the rotational circular member has a continuous spiraling blade thereon for centrifugally moving the material outward and over the edge of said circular member.

7. A metering apparatus according to claim 5 wherein the blades are equally spaced on the surface of the rotatably mounted circular member, each blade extending from the center of the circular member to the outer perimeter of the circular member and having an arc shape.

8. A metering apparatus according to claim 5 or 7 wherein the blades extend beyond the outer perimeter of the rotatably mounted circular member.

9. A metering apparatus according to claim 1 wherein the holes in the stationary pressure plate are equally spaced about the center of the plate at an equal radial distance from the center.

10. A metering apparatus according to claim 9 wherein the vertical probes extend above and below the stationary pressure plate.

11. A metering apparatus according to claim 9 or 10 wherein the vertical probes are equally spaced between adjacent holes in the stationary pressure plate at the same radial distance as the holes.

12. A metering apparatus according to claim 1 wherein the upper hub and the lower hub each has a plurality of tapered arms extending substantially horizontally outward, the tapered arms being equally spaced about the respective hubs.

13. A metering apparatus according to claim 1 wherein the upper hub has a substantially hemispherical shape.

14. A metering apparatus according to claim 1 wherein the lower hub has a substantially circular shape.

15. A metering apparatus according to claim 1 wherein the means for bottom unloading the semi-flowable material from the aeration and conditioning means into the distributing zone comprises a substantially horizontal circular plate having a plurality of holes therein, said horizontal plate being disposed within a conical-shaped member, and a corresponding plurality of elliptical-shaped, tubular columns each with bottom and top openings therein extending downward and inward from the holes in the circular plate.

16. A metering apparatus according to claim 15 wherein the holes in the circular plate are equally spaced about the center of the plate at an equal radial distance from the center.

17. A metering apparatus according to claim 15 wherein the columns extend downward at a substantially 70° angle from horizontal.

18. A metering apparatus according to claim 1 wherein the distributing means comprises a substantially horizontal support surface having a metering edge at its outer perimeter.

19. A metering apparatus according to claim 1 wherein the distributing means comprises a substantially horizontal support surface, a vertical wall extending along and upwardly from the support surface, the wall having a metering edge at its top edge.

20. A metering apparatus according to claim 18 or 19 wherein the metering edge comprises a substantially beveled edge.

21. A metering apparatus according to claim 18 wherein the distributing means further comprises a distributing hub rotatably mounted adjacent the support surface, the hub having a plurality of blades extending substantially horizontally outward.

22. A metering apparatus according to claim 21 wherein the distributing hub has a substantially annular shape.

23. A metering apparatus according to claim 19 wherein the distributing means further comprises a distributing hub rotatably mounted at a height essentially level with the metering edge, the hub having a plurality of sweeps extending substantially horizontally outward.

24. A metering apparatus according to claim 23 wherein the distributing hub has a substantially hemispherical shape.

25. A metering apparatus according to claim 21 or 23 wherein means is provided for linking the upper hub, the lower hub, and the distributing hub for conjoint rotation.

26. A metering apparatus according to claim 25 wherein means is provided for rotating the linking means.

27. An apparatus for metering semi-flowable material, comprising:

means for storing a mass of semi-flowable material, the storage means having a bottom opening therein;

means for bottom unloading the semi-flowable material from the storage means and delivering by gravitational action loosened material at a substantially reduced and controlled head pressure and density into an aeration and conditioning zone;

means for aerating and conditioning the semi-flowable material to prevent the material from compacting and bridging and to provide a mass of semi-flowable material of substantially constant density;

a columnar metering hopper for volumetrically controlling the flow of semi-flowable material out of the aeration and conditioning zone, the hopper having an upper conical-shaped member, a substantially horizontal circular plate being disposed within the conical member, the horizontal plate having a plurality of holes therein, a corresponding plurality of elliptical-shaped, tubular columns extending angularly downward and inward from the horizontal plate, each of the columns having top and bottom openings therein; and means disposed beneath the columnar hopper for distributing the semi-flowable material without inducing packing and bridging of the material for delivery by gravitational action into a collection hopper.

28. A metering apparatus according to claim 27 wherein the pressure and density reducing means comprises a rotational pressure plate mounted in the lower end of the storage means, the rotational pressure plate having an upper surface for centrifugally moving the semi-flowable material to and over the outer edge of the plate, the semi-flowable material being delivered by gravitational action into an aeration and conditioning zone.

29. A metering apparatus according to claim 28 wherein the rotational pressure plate has a plurality of curved blades thereon for centrifugally moving the semi-flowable material to and over the outer edge of the plate.

30. A metering apparatus according to claim 28 wherein the rotational pressure plate has a continuous spiraling blade thereon for centrifugally moving the semi-flowable material to and over the outer edge of the plate.

31. A metering apparatus according to claim 29 wherein the blades are equally spaced on the surface of the rotational pressure plate, each blade extending from the center of the plate to its outer perimeter and having an arc shape.

32. A metering apparatus according to claim 31 wherein the blades extend beyond the outer perimeter of the rotational plate.

33. A metering apparatus according to claim 27 wherein the columns of the columnar metering hopper extend downward at a substantially 70° angle from horizontal.

34. A metering apparatus according to claim 27 wherein the distributing means comprises a substantially horizontal support surface having a metering edge at its outer perimeter and a distributing hub rotatably mounted adjacent the support surface, the distributing hub having a plurality of blades extending substantially horizontally outward.

35. A metering apparatus according to claim 27 wherein the distributing means comprises a substantially horizontal support surface, a vertical wall extending along and upwardly from the support surface, the wall having a metering edge at its top edge, and a distributing hub rotatably mounted at a height essentially level with the metering edge, the distributing hub having a plurality of sweeps extending substantially horizontally outward.

36. A metering apparatus according to claim 34 or 35 wherein the metering edge comprises a substantially beveled edge.

37. An apparatus for metering semi-flowable material, comprising:

a storage hopper for containing a mass of semi-flowable material, the hopper having a cylindrical shape at its upper end and extending downward into a truncated conical shape having a bottom opening therein;

a rotational pressure plate mounted in the truncated end of the storage hopper, the rotational pressure plate having a diameter less than the diameter of the truncated end of the storage hopper and having an upper surface for centrifugally moving the semi-flowable material to and over the outer edge of the rotational pressure plate;

an upper hub rotatably mounted below the rotational pressure plate, the upper hub having a plurality of arms extending substantially horizontally outward therefrom;

a stationary pressure plate mounted adjacent to and below the upper hub and closing the bottom opening in the storage hopper, the stationary pressure plate having a plurality of holes therein;

a plurality of substantially vertical probes extending downward from the bottom surface of the stationary pressure plate into a material retaining ring having an annular shape;

a columnar metering hopper having an upper conical-shaped member disposed adjacent to the material retaining ring, a substantially horizontal circular plate being disposed within the conical member, the horizontal plate having a plurality of holes therein, a corresponding plurality of elliptical-shaped, tubular columns extending angularly downward and inward from the holes in the horizontal plate, the columns having top and bottom openings therein;

a lower hub rotatably mounted above the horizontal plate in the metering hopper, the lower hub having a plurality of arms extending substantially horizontally outward therefrom;

a material support surface located beneath the columnar hopper, the material support surface forming a substantially continuous metering edge at its perimeter;

a distributing hub rotatably mounted adjacent the material support surface and having at least one blade extending substantially horizontally outward therefrom, the blade having a bearing-type facing surface thereon; a shaft linking the distributing hub, the lower hub, the upper hub, and the rotational pressure plate for conjoint rotation;

means for rotating the shaft; and a collection hopper located beneath the material support surface.

38. A metering apparatus according to claim 37 wherein the lower end of the storage hopper extends downward at a substantially 65° angle from horizontal.

39. A metering apparatus according to claim 37 wherein the rotational pressure plate has a plurality of curved blades thereon for centrifugally moving the semi-flowable material to and over the outer edge of said plate.

40. A metering apparatus according to claim 37 wherein the rotational pressure plate has a continuous spiraling blade for centrifugally moving the semi-flowable material to and over the outer edge of said plate.

41. A metering apparatus according to claim 39 wherein the blades are equally spaced on the surface of the rotational pressure plate, each blade extending from the center of the plate to its outer perimeter and having an arc shape.

42. A metering apparatus according to claim 37 wherein the upper hub has a substantially hemispherical shape.

43. A metering apparatus according to claim 37 or 42 wherein the upper hub has four tapered arms disposed equally about the hub.

44. A metering apparatus according to claim 37 wherein the stationary pressure plate has seven holes therein equally spaced about the center of the plate at the equal radial distance from the center.

45. A metering apparatus according to claim 37 or 44 wherein the stationary pressure plate has seven vertical probes extending therefrom, the vertical probes being disposed between adjacent holes in the stationary plate.

46. A metering apparatus according to claim 37 wherein the columnar metering hopper has seven columns extending from seven holes in the horizontal plate, the seven holes in the horizontal plate being equally spaced about the center of the plate at an equal radial distance from the center.

47. A metering apparatus according to claim 37 or 46 wherein the holes in the horizontal plate are not directly underneath the holes in the stationary plate.

48. A metering apparatus according to claim 37 or 46 wherein the columns extend downward at a substantially 70° angle from horizontal.

49. A metering apparatus according to claim 37 wherein the lower hub has a substantially disc-like shape.

50. A metering apparatus according to claim 37 wherein the lower hub has seven tapered arms disposed equally about the hub.

51. A metering apparatus according to claim 37 wherein an annular collar member is disposed above the material support surface, the lower edge of the collar member and the meter edge forming a slot therebetween.

52. A metering apparatus according to claim 51 wherein the material support surface is suspended from the collar member by a plurality of rod members, the rod members being secured between the support surface and the collar member at equidistant points along the perimeter of the members.

53. A metering apparatus according to claim 37 wherein the metering edge comprises a beveled edge.

54. A metering apparatus according to claim 37 wherein the distributing hub has five blades.

55. A metering apparatus according to claim 37 or 54 wherein the distributing blades are equally spaced about the distributing hub, the blades having an arc shape and a flat face.

56. A metering apparatus according to claim 55 wherein the arc-shaped blades are attached substantially tangentially to the distributing hub.

57. An apparatus for use in a metering device for volumetrically delivering semi-flowable material to a distributing stage, comprising:

a columnar hopper including an upper conical-shaped member, a substantially horizontal plate disposed within the conical member, the horizontal plate having a plurality of holes therein, and a corresponding plurality of elliptical-shaped, tubular columns extending angularly downward and inward from the holes in the horizontal plate, each of the columns communicating between the horizontal plate and the distributing stage and being angled inward at a slope sufficient to deliver the material to the distributing stage of the metering device without bridging or packing.

58. An apparatus according to claim 57 wherein the columns extend downward at a substantially 70° angle from horizontal.

59. A method for metering semi-flowable material, comprising the steps of:

bottom unloading semi-flowable material from a storage hopper into an aeration and conditioning zone at a substantially reduced and controlled head pressure and density;

aerating and conditioning the semi-flowable material within the aeration and conditioning zone to prevent the material from compacting and bridging and to place the material in a state of substantially constant density throughout the aeration and conditioning zone;

segregating portions of the aerated and conditioned semi-flowable material and bottom unloading the segregated portions of the semi-flowable material out of the aeration and conditioning zone through inclined tubular columns to support and maintain the material in a substantially constant density state for volumetric delivery by gravitational action into a metering zone; and distributing the semi-flowable material over a metering edge without inducing packing and wedging of the material for gravitational delivery into a collection hopper.

60. Apparatus for metering semi-flowable material, comprising:

a hopper for receiving a mass of semi-flowable material, the hopper having a bottom opening therein;

a first stationary plate mounted in the bottom opening of the hopper, said first stationary plate having a plurality of holes therein for passage of the semi-flowable material;

an upper hub rotatably mounted above the first stationary plate and having at least one arm extending outward therefrom;

a material retaining ring disposed below the first stationary plate;

a second stationary plate mounted below the first stationary plate and having a plurality of holes therein, the second stationary plate supporting a corresponding plurality of tubular columns sloping downward and laterally from the holes in the second stationary plate;

a lower hub rotatably mounted above the second stationary plate and having at least one arm extending outward therefrom;

a material support surface disposed below the bottoms of the tubular columns and defining a metering edge;

a distributing hub rotatably mounted above the material support surface and having at least one blade extending therefrom;

a shaft linking the hubs for conjoint rotation; and means for rotating the shaft.

* * * * *

UNITED STATES PATENT AND TRADEMARK OFFICE

CERTIFICATE OF CORRECTION

PATENT NO. : 4,392,591

DATED : July 12, 1983

INVENTOR(S) : Arthur L. Fassauer

It is certified that error appears in the above—identified patent and that said Letters Patent is hereby corrected as shown below:

(Col. 2, Line 65), "7" should read --7A--.
(Col. 5, Line 14), "3="" should read --3/32"--.

Signed and Sealed this

*Eighth* Day of *November 1983*

[SEAL]

*Attest:*

GERALD J. MOSSINGHOFF

*Attesting Officer* *Commissioner of Patents and Trademarks*